US009231320B2

(12) United States Patent
Paik

(10) Patent No.: US 9,231,320 B2
(45) Date of Patent: Jan. 5, 2016

(54) CONNECTOR AND ELECTRONIC DEVICE INCLUDING THE SAME

(71) Applicant: SAMSUNG ELECTRONICS CO., LTD., Suwon-si (KR)

(72) Inventor: Seung-chul Paik, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/260,501

(22) Filed: Apr. 24, 2014

(65) Prior Publication Data

US 2015/0056863 A1 Feb. 26, 2015

(30) Foreign Application Priority Data

Aug. 23, 2013 (KR) ..... 10-2013-0100502

(51) Int. Cl.

| | |
|---|---|
| ***H01R 13/00*** | (2006.01) |
| ***H01R 12/70*** | (2011.01) |
| ***H01R 12/73*** | (2011.01) |
| ***H01R 27/02*** | (2006.01) |

(52) U.S. Cl.
CPC ..... *H01R 12/7082* (2013.01); *H01R 12/73* (2013.01); *H01R 27/02* (2013.01)

(58) Field of Classification Search
CPC ..... H01R 31/02; H01R 23/025
USPC ..... 439/652, 954, 144, 142, 692, 655, 682, 439/683, 617, 611
See application file for complete search history.

(56) References Cited

U.S. PATENT DOCUMENTS

| | | | | |
|---|---|---|---|---|
| 2,599,023 | A | 6/1952 | Shaul | |
| 4,545,631 | A | 10/1985 | Zampini | |
| 4,747,790 | A * | 5/1988 | Masuda et al. | 439/631 |
| 6,478,616 | B1 * | 11/2002 | Yeh | 439/541.5 |
| 2009/0042448 | A1 | 2/2009 | He et al. | |
| 2010/0267282 | A1 * | 10/2010 | Tsai | 439/607.17 |
| 2011/0065315 | A1 * | 3/2011 | Xuan et al. | 439/540.1 |

FOREIGN PATENT DOCUMENTS

| | | |
|---|---|---|
| EP | 1011300 A2 | 6/2000 |
| WO | 0003518 A1 | 1/2000 |

OTHER PUBLICATIONS

Communication issued on Feb. 2, 2015 by the European Patent Office in counterpart European Application No. 14170660.6.

* cited by examiner

*Primary Examiner* — Phuongchi T Nguyen
(74) *Attorney, Agent, or Firm* — Sughrue Mion, PLLC

(57) ABSTRACT

A connector that is configured to be installed on a printed circuit board (PCB) and electrically connected to an external terminal is provided. The connector may include a first port that is disposed on the PCB and is configured to accept a first external terminal into the first port in a first direction, and a second port that is layered on top of the first port and is configured to accept a second external terminal into the second port in a second direction that is formed at an angle from the first direction.

9 Claims, 6 Drawing Sheets

CONNECTOR AND ELECTRONIC DEVICE INCLUDING THE SAME

CROSS-REFERENCE TO RELATED APPLICATION

This application claims priority from Korean Patent Application No. 10-2013-0100502, filed on Aug. 23, 2013 in the Korean Intellectual Property Office, the disclosure of which is incorporated herein by reference in its entirety.

BACKGROUND

1. Field

Apparatuses and methods consistent with exemplary embodiments relate to a connector and an electronic device including the same, and more particularly, to a connector and an electronic device including the same which provides improved usability with multi-layer connectors.

2. Description of the Related Art

Electronic devices such as a television (TV), a monitor, a computer, and a mobile terminal may perform various functions including outputting images, web-surfing, games, photos, and recording video. Further, the electronic devices may be connected to an external device in a wired manner and transmit data thereto. For example, a TV may be connected to a universal serial bus (USB) memory stick and receive and output movies, music, photos and other data stored on a Universal Serial Bus (USB) memory stick. To do so, a USB port should be provided in the TV to connect the USB memory stick to the TV.

An electronic device may use a cable that includes USB and high definition multimedia interface (HDMI) terminals configured to be connected to an external storage medium or another electronic device. Thus, the electronic device has a connector to which the USB and HDMI terminals are inserted and electrically connected. A related art connector of an electronic device is a single-layer connector, or a multi-layer connector into which external terminals are inserted in the same direction.

In the case of a single-layer connector, the connector may be located within a circumference of a printed circuit board (PCB) in order to connect the external terminal thereto. In this case, if there are many external connection materials, the connector should be arranged along a circumference of the PCB, and this may increase the size of the PCB.

In the case of a multi-layer connector, external terminals may be inserted as multi-layers in the same direction, and the PCB may not become larger. However, due to the multi-layer connector, the electronic device becomes thicker.

Referring to FIG. 1, in a related art multi-layer connector, two ports 1 and 2 are provided as multi-layers, and an external terminal 3 inserted into a first-layer port and an external terminal 4 inserted into a second-layer port are inserted in the same direction. The gap between the first and second ports 1 and 2 is minimized by taking into account the thickness of the electronic device. In this case, the external terminals 3 and 4 may interfere with each other when they are inserted into or removed from the first and second ports 1 and 2.

SUMMARY

One or more exemplary embodiments provide a connector that is arranged in multi-layers and provides improved usability by varying insertion directions of external terminals.

According to an aspect of an exemplary embodiment, there is provided a connector that is configured to be installed on a printed circuit board (PCB) and electrically connected to an external terminal. The connector includes a first port that is disposed on the PCB and is configured to accept insertion of a first external terminal in a first direction, and a second port that is layered on top of the first port and is configured to accept insertion of a second external terminal into the second port in a second direction that is offset by an angle from the first direction.

The angle may be within a permissible range in which the first external terminal and the second external terminal do not interfere with each other when they are inserted or removed from the first port and the second port, respectively.

The first direction may be parallel to a plane of the PCB, and the second direction may be offset by the angle with respect to the first direction toward a plane that is perpendicular to the PCB.

The first external terminal may be one of a first universal serial bus (USB) terminal and a high definition multimedia interface (HDMI) terminal, and the second external terminal may be a second USB terminal.

The first direction and the second direction may be parallel to the horizontal PCB, and may form the angle therebetween on a plane that is parallel to the PCB.

The first external terminal and the second external terminal may be one of at least a USB terminal and an HDMI terminal.

According to an aspect of another exemplary embodiment, there is provided an electronic device that includes a connector that is configured to be installed on a printed circuit board (PCB) and electrically connected to an external terminal, wherein the connector includes a first port that is disposed on the PCB and is configured to accept insertion of a first external terminal in a first direction, and a second port that is layered on top of the first port and is configured to accept insertion of a second external terminal in a second direction that is offset by an angle from the first direction.

The angle may be within a permissible range in which the first external terminal and the second external terminal do not interfere with each other when they are inserted or removed from the first port and the second port, respectively.

The first direction may be parallel to the horizontal PCB, and the second direction may form at the angle to the first direction toward a plane that is perpendicular to the PCB.

The first external terminal may be one of a first universal serial bus (USB) terminal and a high definition multimedia interface (HDMI) terminal, and the second external terminal may be a second USB terminal.

The first direction and the second direction may be parallel to the horizontal PCB, and form the angle therebetween on a plane that is parallel to the PCB.

The first external terminal and the second external terminal may be one of at least a USB terminal and an HDMI terminal.

According to an aspect of another exemplary embodiment, there is provided an electronic connector disposed on a printed circuit board (PCB), the electronic connector including: a first port disposed at a first angle that is parallel to a surface of the PCB; and a second port disposed above the first port at a second angle that has a non-zero angle of incidence between the PCB surface and an entrance vector of the second port.

According to an aspect of another exemplary embodiment, there is provided an electronic connector disposed on a printed circuit board (PCB), the electronic connector including: a first port disposed at a vertical angle that is parallel to a surface of the PCB; and a second port disposed above the first port at the vertical angle; wherein the first port is provided at a first horizontal entrance vector and the second port is configured at a second horizontal entrance vector, and wherein the first horizontal entrance vector and the second horizontal entrance vector have a horizontal non-zero angle between them.

BRIEF DESCRIPTION OF THE DRAWINGS

The above and/or other aspects will become apparent and more readily appreciated from the following description of exemplary embodiments, taken in conjunction with the accompanying drawings, in which.

and

Figure 6:
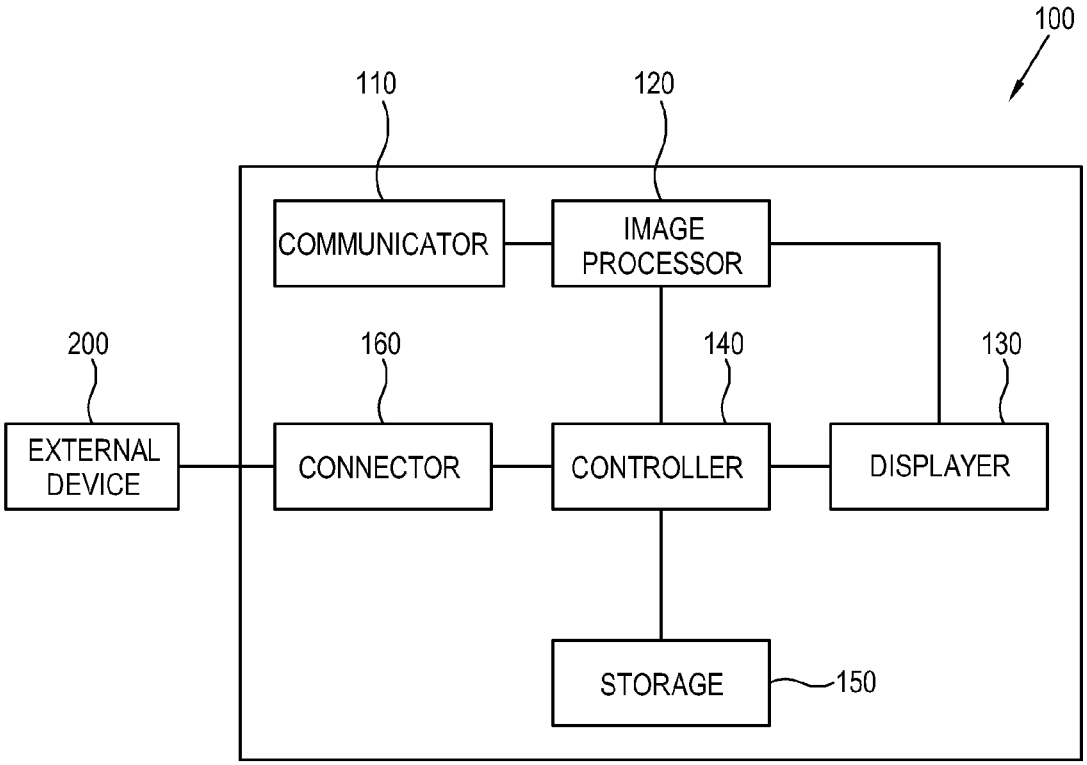

FIG. 6 is a block diagram of an electronic device which includes a connector according to an exemplary embodiment.

DETAILED DESCRIPTION OF EXEMPLARY EMBODIMENTS

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Hereinafter, a connector and an electronic device including the same according to an exemplary embodiment will be described in detail with reference to accompanying drawings.

A connector according to an exemplary embodiment is a connection part of an electronic device to which an external device is connected. The connector may be provided in a lateral side of the electronic device and configured to be connected to the external device. The external device may include a memory in which videos and pictures and other data may be stored, or may include a device that is connected to the electronic device and drives the electronic device. The connector may be a connection terminal that complies with normal standards. For example, the connector of the electronic device may be connected through a universal serial bus (USB) or high definition multimedia interface (HDMI) cable. Further, the electronic device may be any electronic device such as a television (TV), a computer, a monitor, or an instrumentation in which a connector may be provided. The external device that is connected to the connector of the electronic device may include a mobile terminal such as a mobile phone, a personal digital assistant (PDA), or an MP3 player or a camera, a printer, a scanner, a webcam, an external hard disc, etc. or identical electronic devices may be connected to each other.

The connector according to the exemplary embodiments may be directly connected to an external device such as a USB memory stick, or to a cable including a power source, USB, HDMI terminals. The shape of the connector is not limited to the shape shown in drawings, and may vary corresponding to various types of terminals provided in the external device or cable.

Figure 1:
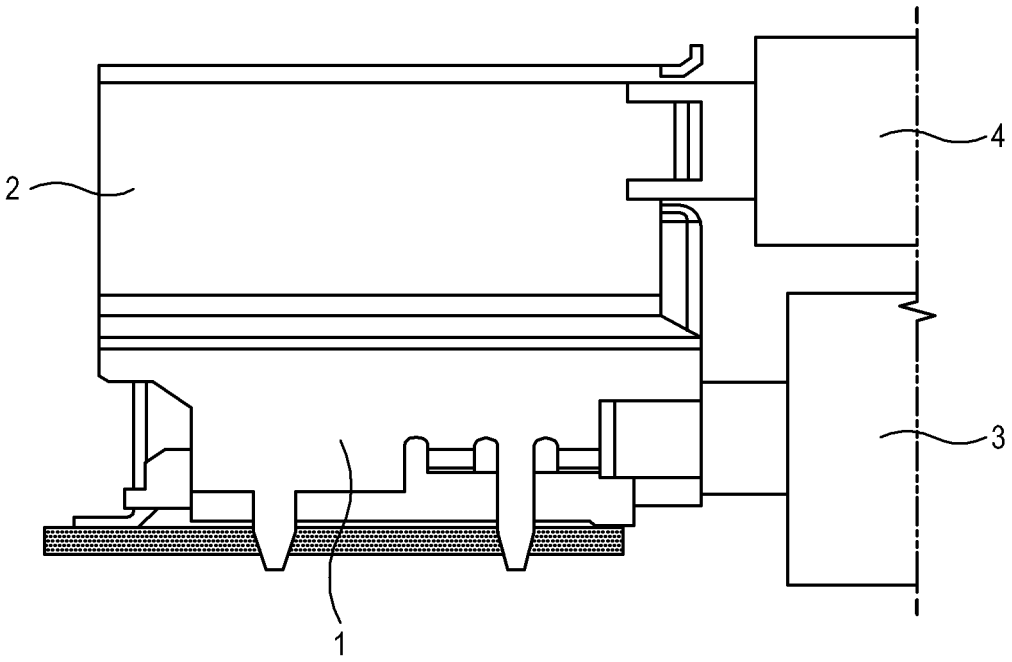
FIG. 1 is a cross sectional side view of a related art multi-layer connector.
Figure 2:
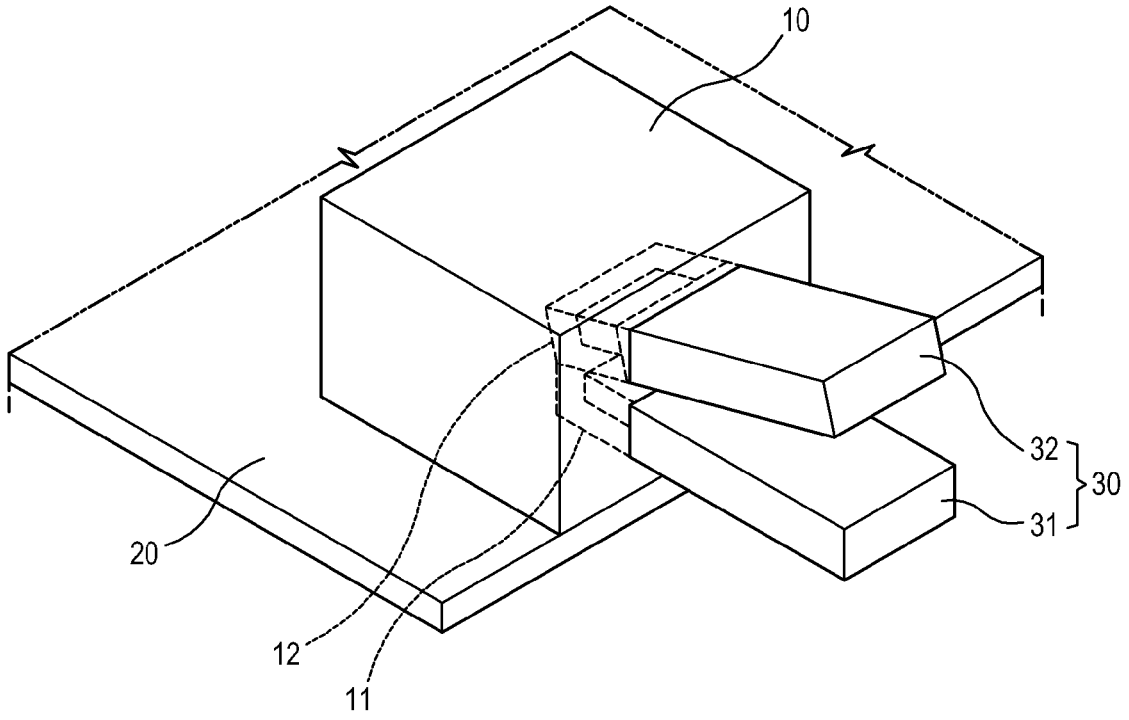
FIG. 2 is a perspective view of a connector according to an exemplary embodiment.
Figure 3:
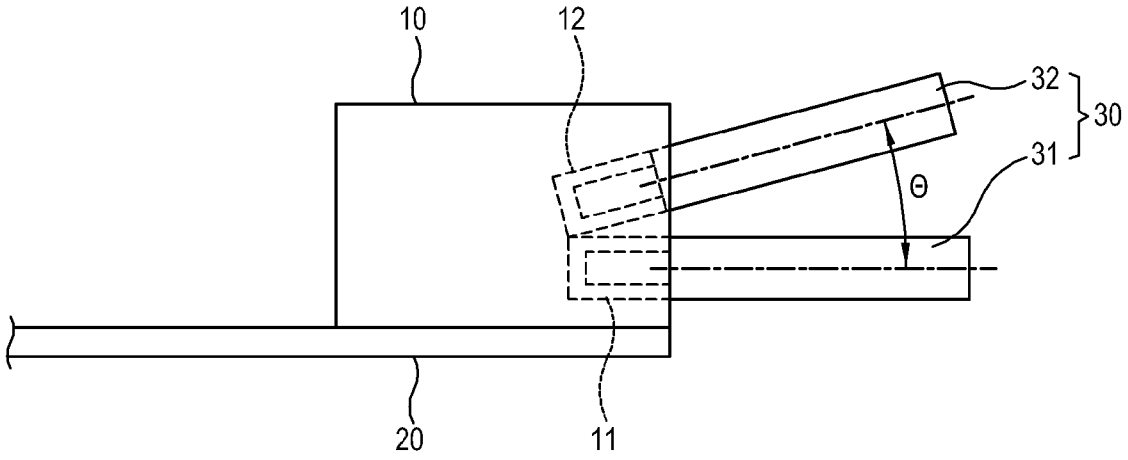
FIG. 3 is a side view of a connector according to an exemplary embodiment.
Figure 4:
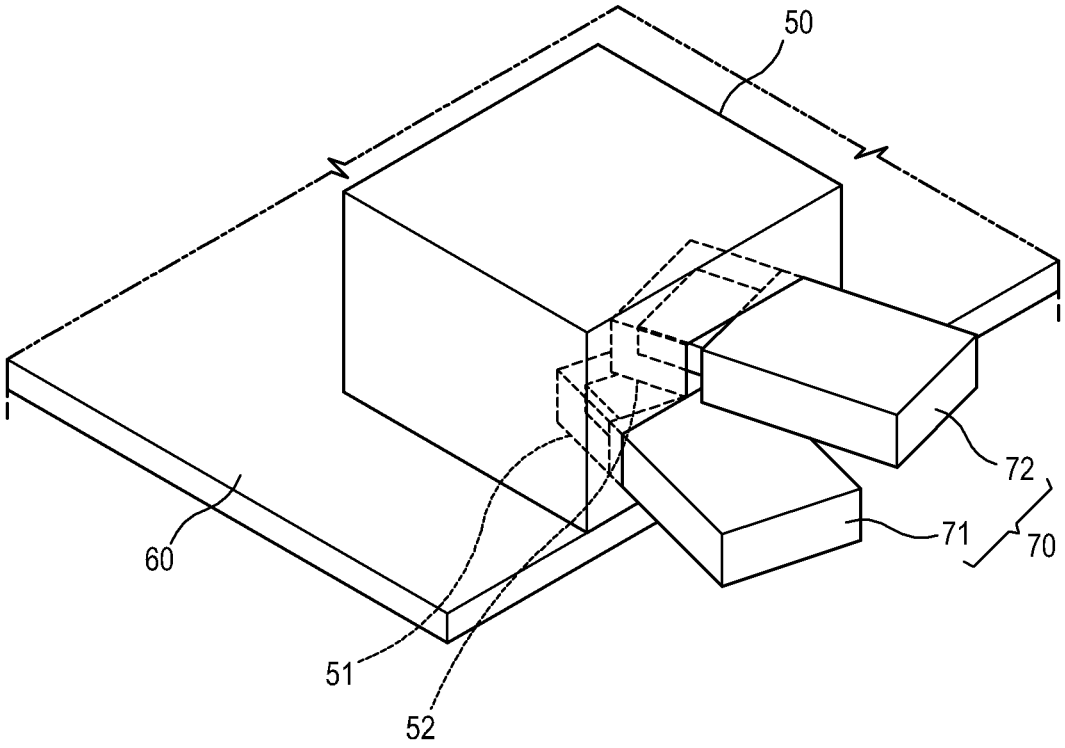
FIG. 4 is a perspective view of a connector according to an exemplary embodiment.

FIGS. 2 and 4 illustrate a multi-layer connector that is provided in a printed circuit board (PCB) according to an exemplary embodiment, but some of elements have been omitted to clarify features of the exemplary embodiment. In particular, wires are formed in a port of the connector, to which an external terminal is inserted, to electrically connect the external terminal. Such wires are electrically connected to the PCB, but the electrical wires have been omitted from FIGS. 2 to 5.

FIG. 2 is a perspective view of a connector 10 and an external terminal 30 that is connected to the connector 10 according to the exemplary embodiment. FIG. 3 is a side view of the connector 10 and the external terminal 30 as similarly shown in FIG. 2.

Referring to FIGS. 2 and 3, the connector 10 according to the exemplary embodiment is installed on a PCB 20 and is electrically connected to the external terminal 30. The connector 10 includes a first port 11 which is provided on the PCB 20, and a second port 12 which is layered on the first port 11.

The first port 11 is provided so that the first external terminal 31 is inserted into the first port in a direction that is horizontal with respect to or parallel to the PCB 20.

The second port 12 is layered on the first port 11, and is provided at an angle θ with respect to the direction in which the first external terminal 31 is inserted into the first port 11 on a plane that is vertical or perpendicular to the PCB 20. The second external terminal 32 is inserted into the second port 12 by forming an angle θ to the first external terminal 31.

The angle θ formed between the first and second external terminals 31 and 32 is within a permissible range so that the first and second external terminals 31 and 32 do not interfere with each other when they are inserted into or removed from the first and second ports 11 and 12, respectively.

The angle θ may be set not to be too wide. If the angle θ is wide, the angle is set such that the first and second external terminals 31 and 32 do not interfere with each other when being inserted into or removed from the first and second ports 11 and 12 and usability may be improved. However, with the wide angle of the second port 12, the connector 10 may become thicker and may act as an obstacle when attempting to make an electronic device small and/or slim. Accordingly, designation of such an angle may be set such that usability is maximized and the connector 10 is a proper thickness by taking into account the shape and thickness of the external terminals 30 which are inserted into the first and second ports 11 and 12.

According to an exemplary embodiment, cables including USB and HDMI terminals may be used to connect an external device to an electronic device. Accordingly, the first and second ports 11 and 12 may be provided so that USB and HDMI terminals may be inserted thereinto. For example, if the connector 10 which may accommodate a USB terminal and an HDMI terminal is provided, the first port 11 may accommodate the HDMI terminal therein and the second port 12 may accommodate the USB terminal therein to minimize the thickness of the connector 10 and improve usability. This is assuming the port connected to the USB terminal should be longer than the port connected to the HDMI terminal. Thus, according to an exemplary embodiment the longer port may be provided on an upper side, thereby improving usability with a minimum angle and such minimum angle may make the connector thinner.

Figure 5:
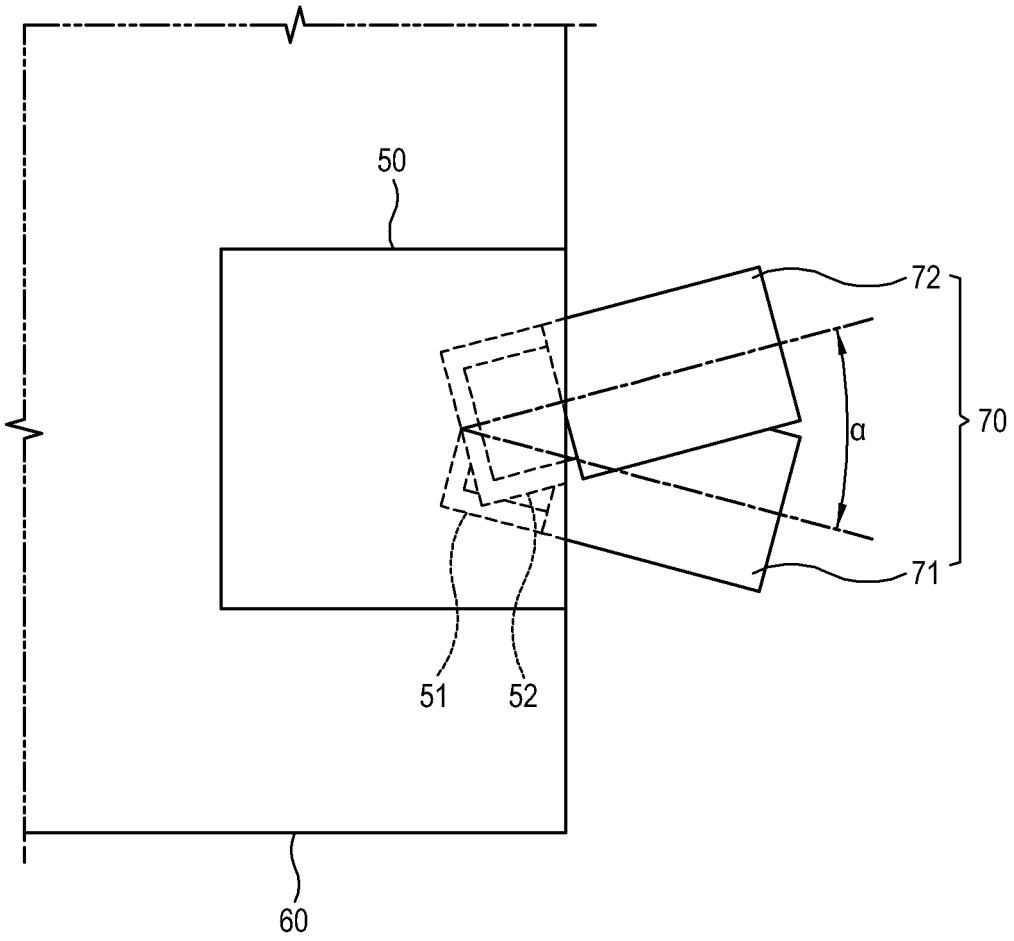
FIG. 5 is a plan view of a connector according to an exemplary embodiment.

FIG. 4 is a perspective view of a connector 50 and an external terminal 70 connected to the connector 50 according to another exemplary embodiment. FIG. 5 is a plan view of the connector 50 and the external terminal 70 as similarly shown in FIG. 4.

Referring to FIGS. 4 and 5, the connector 50, according to an exemplary embodiment, is installed on a PCB 60 and is electrically connected to the external terminal 70. The connector 50 includes a first port 51 that is provided on the PCB 60, and a second port 52 that is layered on an upper side of the first port 51.

The first port 51 is provided so that the first external terminal 71 is inserted into the first port 51 in a direction that is parallel to the horizontal plane of the PCB 60. The second port 52 is layered on the first port 51, and is provided so that the second port 52 is also parallel to the horizontal plane of the PCB 60. Further, the second port 52 is formed at an angle $\alpha$ from the insertion direction of the first external terminal 71.

The angle $\alpha$ that is formed between the first and second external terminals 71 and 72 is within a permissible range so that the first and second external terminals 71 and 72 do not interfere with each other when they are inserted into or removed from the first and second ports 51 and 52.

The angle $\alpha$ is set not to be too wide. Because the connectors 50 are provided in left and right sides of an electronic device in general, if the angle $\alpha$ is wide, the first and second external terminals 71 and 72 may interfere with the lateral side of the electronic device and thus usability may deteriorate. Accordingly, the angle $\alpha$ which may maximize usability should be designated by taking into account the shape and thickness of the external terminals 70 inserted into the first and second ports 51 and 52 and the location of the connector 50 provided in the electronic device.

FIG. 6 is a block diagram of an electronic device 100 which may include a connector 160 according to another exemplary embodiment. Hereinafter, an example of the electronic device 100 including the connector 160 according to the present exemplary embodiment will be described, but the configuration of the electronic device 100 is not limited to the foregoing and may otherwise vary.

As shown in FIG. 6, the electronic device 100 includes a communicator 110 which receives and transmits a data signal from/to the outside; an image processor 120 which processes an image signal received by the communicator 110; a display 130 which outputs an image signal that has been processed by the image processor 120; a controller 140 which controls entire operations of the electronic device 100; a storage part 150 which stores therein data regarding operations corresponding to predetermined commands; and the connector 160 which is provided in the electronic device 100 and is connected to an external device 200.

The electronic device 100 may be, or may be included in, any electronic device such as a TV, a computer, a monitor, or an instrumentation in which the connector 160 may be provided. The external device 200 which is connected to the connector 160 of the electronic device 100 may include a mobile device such as a mobile phone, a PDA, an MP3 player or a camera, a printer, a scanner, a webcam, or an external hard disc. Also, identical electronic devices may be connected to each other.

A connection terminal of the external device 200 that is connected to the connector 160 may include a USB, HDMI, etc., and the shape of the connector 160 is not limited to the shape shown in FIGS. 2 to 5 and may vary as long as it can be connected to the external device 200. A power terminal may be inserted into the connector 160 to receive power from the outside.

According to the exemplary embodiment, multi-layer connectors are provided so that external terminals may be inserted into the connectors from different directions and angles, and the external terminals may minimize interference which may arise when they are inserted into or removed from the connectors, and usability may improve.

According to the exemplary embodiment, the electronic device which includes the connector may have different insertion directions of external terminals which are inserted into the connectors to thereby improve usability and minimizes the thickness of an electronic device in which the multi-layer connector is provided.

Although a few exemplary embodiments have been shown and described, it will be appreciated by those skilled in the art that changes may be made in these exemplary embodiments without departing from the principles and spirit of the inventive concept, the range of which is defined in the appended claims and their equivalents.

What is claimed is:

1. A connector that is configured to be installed on a printed circuit board (PCB) and electrically connected to an external terminal, the connector comprising:

a first port that is disposed on the PCB and is configured to accept insertion of a first external terminal in a first direction; and a second port that is layered on top of the first port and is configured to accept insertion of a second external terminal into the second port in a second direction;

wherein the second direction forms a non-zero angle with respect to the first direction, and wherein the first direction and the second direction are parallel to a surface of the PCB and the second direction forms the non-zero angle with respect to the first direction in a plane that is parallel to the surface of the PCB.

2. The connector according to claim 1, wherein the non-zero is within a permissible range in which the first external terminal and the second external terminal do not interfere with each other when they are inserted or removed from the first port and the second port, respectively.

3. The connector according to claim 1, wherein the first external terminal is one of a first universal serial bus (USB) terminal and a high definition multimedia interface (HDMI) terminal, and the second external terminal is a second USB terminal.

4. The connector according to claim 1, wherein the first external terminal and the second external terminal are one of a universal serial bus (USB) terminal and a high definition multimedia interface (an-HDMI) terminal.

5. An electronic device comprising:

a connector that is installed on a printed circuit board (PCB) and electrically connected to an external terminal, wherein the connector comprises:

a first port that is disposed on the PCB and is configured to accept insertion of a first external terminal in a first direction; and a second port that is layered on top of the first port and is configured to accept insertion of a second external terminal in a second direction;

wherein the second direction forms a non-zero angle with respect to the first direction, and wherein the first direction and the second direction are parallel to a surface of the PCB and the second direction forms the non-zero angle with respect to the first direction in a plane that is parallel to the surface of the PCB.

6. The electronic device according to claim 5, wherein the non-zero angle is within a permissible range in which the first external terminal and the second external terminal do not interfere with each other when they are inserted or removed from the first port and the second port, respectively.

7. The electronic device according to claim 5, wherein the first external terminal is one of a first universal serial bus (USB) terminal and a high definition multimedia interface (HDMI) terminal, and the second external terminal is a second USB terminal.

8. The electronic device according to claim 5, wherein the first external terminal and the second external terminal are one of a universal serial bus (USB terminal and a high definition multimedia interface (an HDMI terminal.

9. An electronic connector disposed on a printed circuit board (PCB), the electronic connector comprising:

a first port oriented in a first direction that is parallel to a surface of the PCB; and a second port disposed above the first port and oriented in a second direction that is parallel to the surface of the PCB;

wherein the second direction forms a non-zero angle with respect to the first direction in a plane parallel to the surface of the PCB, wherein the first direction and the second direction are parallel to the surface of the PCB and the second direction forms the non-zero angle with respect to the first direction in a plane that is parallel to the surface of the PCB.

* * * * *